US009702526B2

(12) United States Patent
Kadoriku et al.

(10) Patent No.: US 9,702,526 B2
(45) Date of Patent: Jul. 11, 2017

(54) ILLUMINATION DEVICE

(71) Applicant: Panasonic Intellectual Property Management Co., Ltd., Osaka (JP)

(72) Inventors: Shinji Kadoriku, Osaka (JP); Ryoma Murase, Osaka (JP); Masaru Fujita, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 36 days.

(21) Appl. No.: 14/773,378

(22) PCT Filed: Oct. 24, 2014

(86) PCT No.: PCT/JP2014/005406
§ 371 (c)(1),
(2) Date: Sep. 7, 2015

(87) PCT Pub. No.: WO2015/064073
PCT Pub. Date: May 7, 2015

(65) Prior Publication Data

US 2016/0018081 A1 Jan. 21, 2016

(30) Foreign Application Priority Data

Oct. 31, 2013 (JP) ..... 2013-226204

(51) Int. Cl.
*F21V 13/04* (2006.01)
*F21V 5/00* (2015.01)
(Continued)

(52) U.S. Cl.
CPC ..... *F21V 13/04* (2013.01); *F21S 48/1154* (2013.01); *F21S 48/1275* (2013.01);
(Continued)

(58) Field of Classification Search
CPC .. F21V 13/04; F21V 5/007; F21V 7/04; F21S 48/1154; F21S 48/145
See application file for complete search history.

(56) References Cited

U.S. PATENT DOCUMENTS 8,390,763 B2 * 3/2013 Ogasawara ..... G02B 3/0056 349/64
2004/0042212 A1 3/2004 Du et al.
2009/0257000 A1 10/2009 Ogasawara et al.

FOREIGN PATENT DOCUMENTS

JP 2005-537665 12/2005
JP 2007-225853 9/2007
(Continued)

OTHER PUBLICATIONS

International Search Report of PCT application No. PCT/JP2014/005406 dated Jan. 27, 2015.

*Primary Examiner* — Anabel Ton
(74) *Attorney, Agent, or Firm* — Panasonic IP Management; Kerry S. Culpepper

(57) ABSTRACT

An illumination device has plural LED light sources, a reflection plate that has plural openings facing the respective LED light sources, and plural lenses that faces the respective openings and that guides light emitted from the plural openings in a direction vertical to the openings. The reflection plate is placed between the plural LED light sources and the plural lenses, and converges the light emitted from the plural LED light sources.

18 Claims, 21 Drawing Sheets

(51) Int. Cl.

| | |
|---|---|
| ***F21V 7/04*** | (2006.01) |
| ***F21S 8/10*** | (2006.01) |
| *F21Y 115/30* | (2016.01) |
| *F21Y 105/10* | (2016.01) |

(52) U.S. Cl.
CPC ..... *F21S 48/145* (2013.01); *F21V 5/007* (2013.01); *F21V 7/04* (2013.01); *F21Y 2105/10* (2016.08); *F21Y 2115/30* (2016.08)

(56) References Cited

FOREIGN PATENT DOCUMENTS

| | | |
|---|---|---|
| JP | 2009-258298 | 11/2009 |
| JP | 2012-038431 | 2/2012 |
| JP | 2013-073080 | 4/2013 |

* cited by examiner

ILLUMINATION DEVICE

TECHNICAL FIELD

The present invention relates to an illumination device. Particularly, the invention relates to an illumination device using a light-emitting diode.

BACKGROUND ART

Recently, as a headlight for vehicles, there is an illumination device 100 that uses a light-emitting diode (LED) (Patent Literature 1).

FIG. 21 is a cross-section view of the above-mentioned conventional illumination device 100. It includes a LED light source 10 of the illumination device 100, a substrate 11, a reflection plate 12, and an opening 13. The light emitted from the LED light source 10 is reflected by the reflection plate 12, and is emitted forward through the opening 13.

The LED light source 10 is a high output LED, and is a point light source. A shape of the reflection plate 12 is determined based on the optical design with respect to the point light source. Since the LED light source 10 is a high output LED, it generates a high amount of heat. Therefore, a cooling mechanism is provided on or under the substrate 11 (not shown in the figure).

CITATION LIST

Patent Literature

PTL 1: JP2005-537665A

SUMMARY OF INVENTION

An illumination device according to the invention has plural light-emitting elements; a reflection plate that has plural opening parts facing the plural light-emitting elements; and plural lenses that face the plural opening parts and that condense light emitted from the plural openings in directions vertical to the opening faces. The reflection plate is placed between the light-emitting elements and the lenses, and shields the light emitted from the adjacent light-emitting elements.

According to the illumination device of the invention, plural LEDs are used, and a reflector that has openings respectively corresponding to the LEDs is used. Furthermore, according to the illumination device of the invention, plural lenses respectively corresponding to the openings are used. As a result, a thin LED illumination device is realized. Additionally, the illumination device of the invention does not require a specific heat-releasing structure.

DESCRIPTION OF EMBODIMENTS

Prior to descriptions of embodiments of the invention, problems in the above-mentioned conventional illumination device will briefly be described. The illumination device described in Patent Literature 1 has one LED, and therefore, requires a high output to secure a sufficient illumination intensity. Additionally, the illumination device involves high heat generation with the high output. Therefore, the illumination device separately requires a special cooling mechanism, and further, a part of the reflection plate becomes larger in terms of the optical design.

Hereinafter, as illumination devices using LEDs, illumination devices according to embodiments of the invention that has a thin structure and that do not require a special heat-releasing structure will be described with reference to drawings. In addition, in each embodiment, the same reference symbols may be provided to the same elements, and detailed description may be omitted.

First Embodiment

Figure 1A:
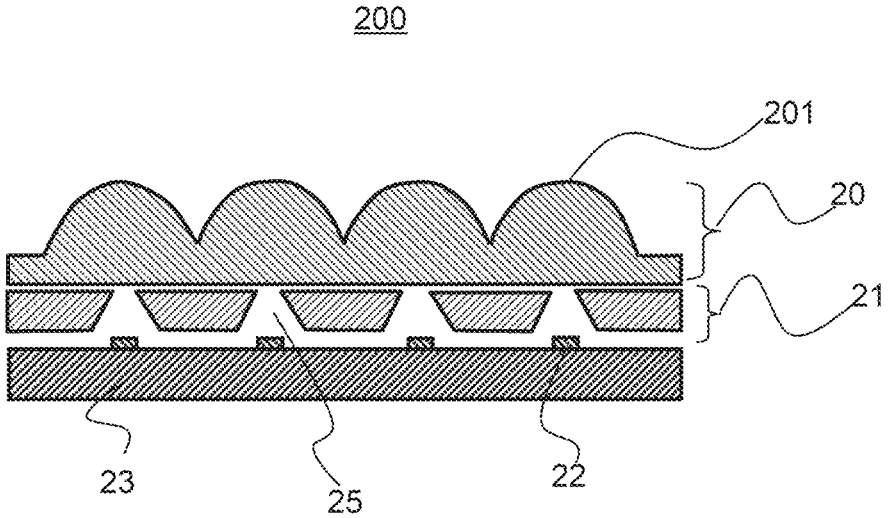
FIG. 1A is a cross-section view of an illumination device according to a first embodiment.
Figure 1B:
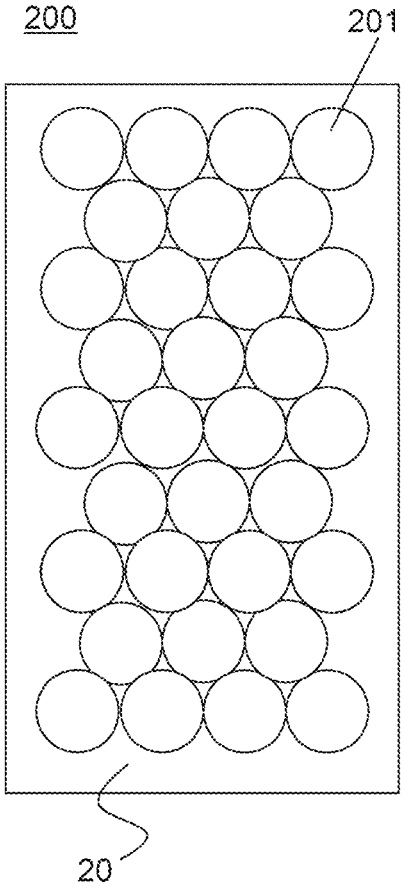
FIG. 1B is a plan view of the illumination device according to the first embodiment.
Figure 1C:
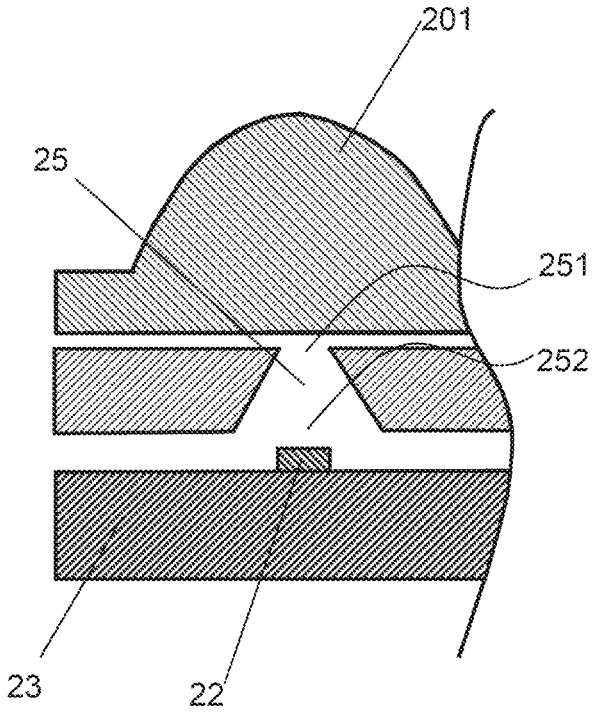
FIG. 1C is an enlarged cross-section view of the illumination device according to the first embodiment.

An illumination device 200 according to the first embodiment will be described with reference to in FIGS. 1A-1C. FIG. 1A is a cross section of the illumination device 200. FIG. 1B is a plan view thereof. FIG. 1C is an enlarged cross-section view of the illumination device 200.

The illumination device 200 of the first embodiment includes a lens unit 20, a reflector unit 21 located below it, LED light sources 22 that are plural light-emitting elements located below it, and a substrate 23 on which the LED light sources 22 are mounted. The LED light sources 22 are laser diodes, and a plurality of them is mounted on the substrate 23.

The lens unit 20 has plural hemispherical lenses, corresponding to the respective LED light sources 22, on its upper portion. The lenses are produced by resin molding.

The reflector unit 21 is located between the lens unit 20 and the LED light sources 22.

A through hole, corresponding to each of the plural LED light sources 22, is formed therein. An opening, having an area smaller than that of a lower part of the through hole, is provided in an upper part of the through hole, and thus, the light is condensed therein.

The reflector unit 21 is a reflection plate that reflects and converges the light in its inside. The reflector unit 21 is formed of a metal plate or a resin material with high reflectance, such as a high reflection polybutylene terephthalate resin, a high reflection polycarbonate resin, a high reflection nylon resin, or a high reflection foaming resin.

The light from LED light sources 22 is collected by the reflector unit 21, and is guided from opening upper parts 251 in the reflector unit 21 to the lens unit 20. The light is emitted in the upright direction (in the figures) through lenses 201.

FIG. 1B is a plan view of the illumination device 200. The plural hemispherical lenses 201 are arrayed closely on the upper part of the lens unit 20.

FIG. 1C is an enlarged cross-section view of the illumination device 200, and provides an understanding of a shape of the opening 25. The opening upper part 251 is present in an upper portion of the illumination device 200, and the opening lower part 252 is present in a lower portion of the same. The opening becomes narrower toward the upper portion of the illumination device 200. According to this structure, the light emitted from the LED light sources 22 is condensed.

Figure 2A:
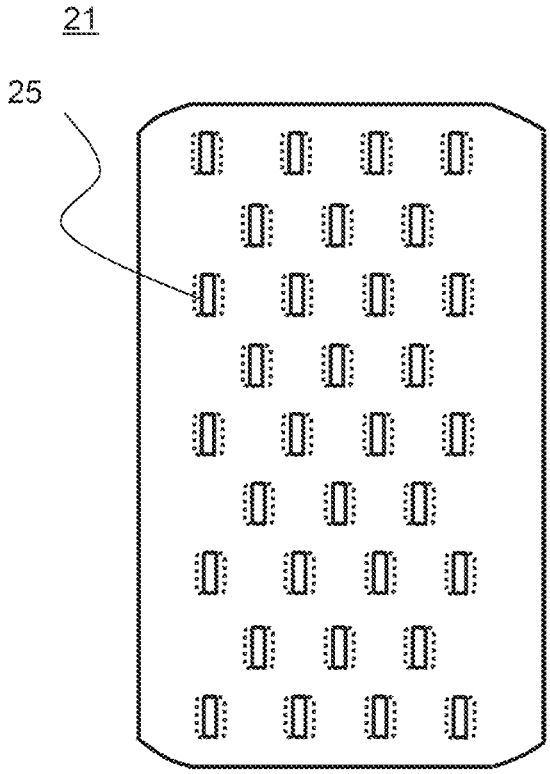
FIG. 2A is a plan view of a reflector unit in the first embodiment.
Figure 2B:
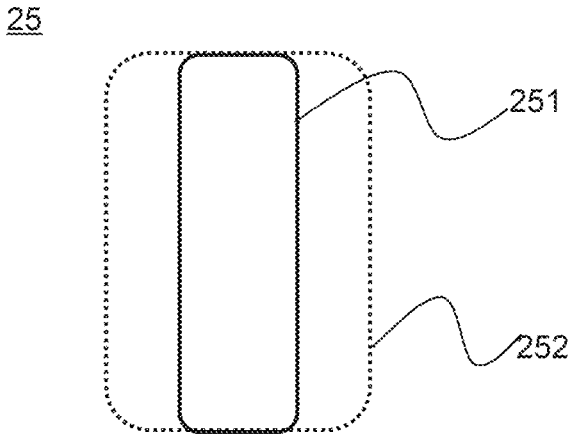
FIG. 2B is an enlarged plan view of an opening part of the reflector unit in the first embodiment.

FIG. 2A is a plan view of the reflector unit 21. Openings 25 are provided thereon so as to correspond to the lenses. FIG. 2B is an enlarged plan view of one opening 25 of the reflector unit 21. The reflector unit 21 has a rectangular opening upper part 251 and a rectangular opening lower part 252. The cross-section area of the through hole is reduced upward in the thickness direction of the reflector unit 21.

In the first embodiment, the size of opening upper part 251 is 2 mm×1 mm. The size of opening lower part 252 is 2 mm×2 mm. The lens 201 is aspherical, and is a hemisphere with a radius of 5 mm. The opening 25 is narrowed in the horizontal direction in the figure. It is not narrowed in the vertical direction.

Because the illumination device 200 includes plural LED light sources 22, the heat from LED light sources 22 does not converge, and therefore, any special cooling mechanism is not required. The light is reflected and cut at the opening 25 in the reflector unit 21. Then, the light is transmitted forward through the lens unit 20, and therefore, a large reflection plate (reflector) is also not required.

Because there are a LED light source 22, an opening 25 of the reflector unit 21 and a lens 201 in a straight line, the light is efficiently emitted therefrom.

Second Embodiment

Figure 3A:
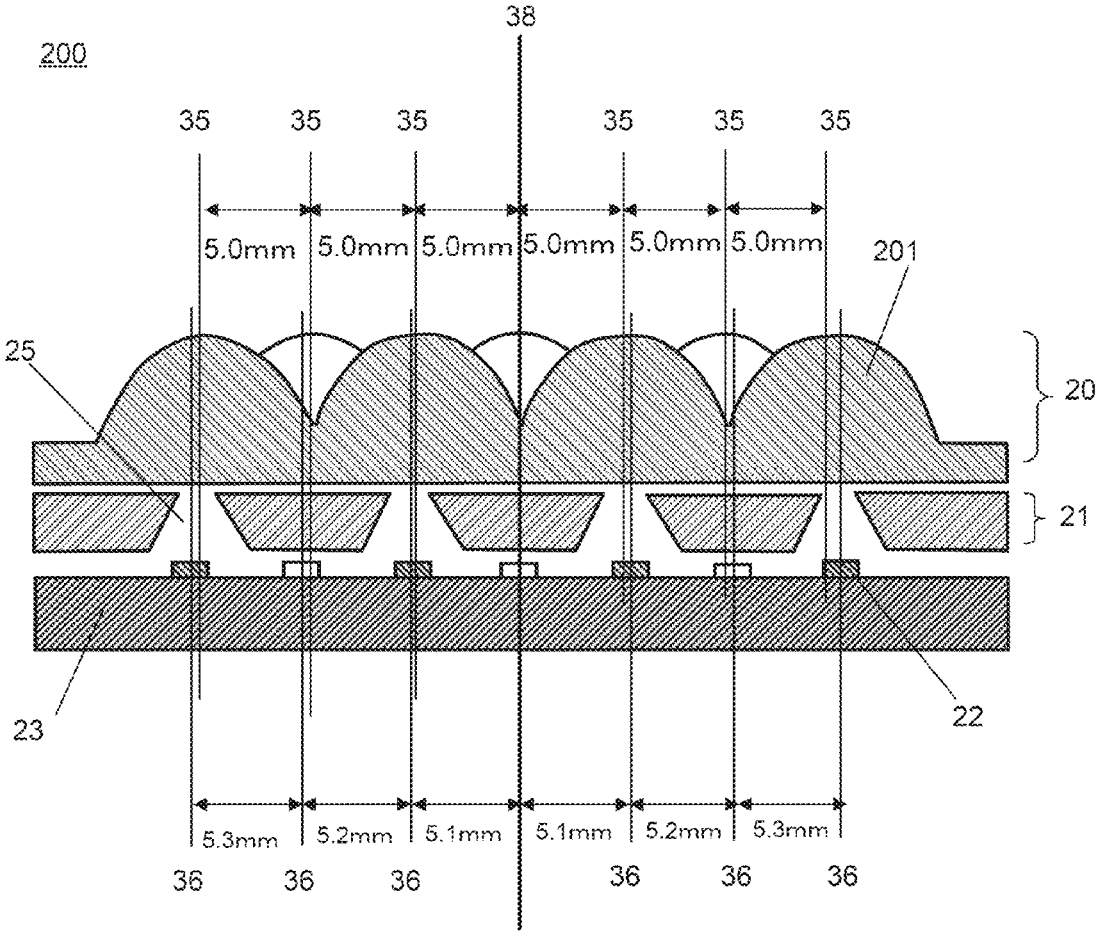
FIG. 3A is a cross-section view of an illumination device according to a second embodiment.
Figure 3B:
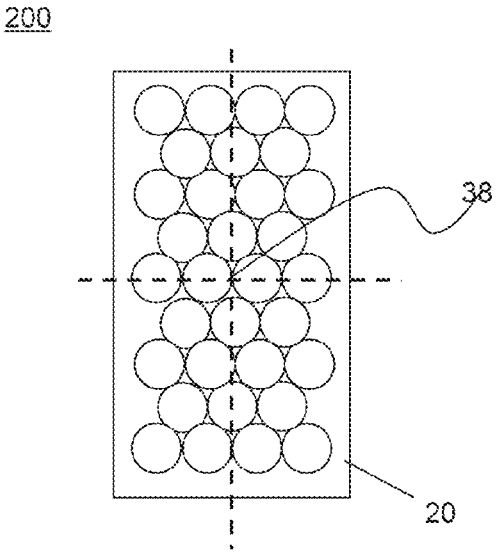
FIG. 3B is a plan view of the illumination device according to the second embodiment.

The second embodiment will be described by use of FIGS. 3A to 5. Parts different from the first embodiment will be described. FIG. 3A is a cross-section view of an illumination device 200. FIG. 3B is a plan view of the illumination device 200. FIG. 3A is a diagram that corresponds to FIG. 1A. The difference between this embodiment and the first embodiment is that positions of lens central axes 35 and LED light source central axes 36 are not agreed with each other. Their positions are displaced in the horizontal and vertical directions from a center of the central axis 38 of the illumination device 200. A quantity by which the position is displaced becomes larger toward the edges of the illumination device 200.

In FIG. 3A, the LED light source central axes 36 are spread further by 0.1 mm toward the edge portions. The increment does not need to be constant.

FIGS. 4A to 4H illustrate light quantity distributions and traveling courses of the light in such a state of displaced positions.

The light quantity distributions are results of an optical simulation, and are data in a case where an object 25 m ahead of the illumination device 200 is assumed. The same applies to the figures below.

Figure 4A:
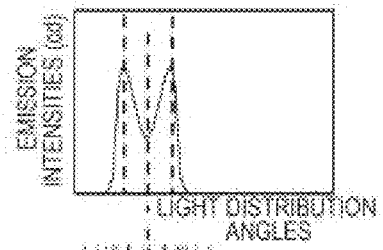
FIG. 4A is a diagram that shows a light quantity distribution versus a light distribution angle when lens central axes 35 and LED light source central axes 36 agree with each other in the illumination device of the second embodiment.
Figure 4B:
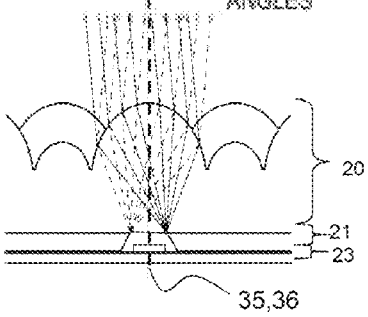
FIG. 4B is a cross-section view that illustrates a traveling state of the light in the instance of FIG. 4A.

FIG. 4A shows a light quantity distribution versus a light distribution angle when the lens central axes 35 and the LED light source central axes 36 are aligned with each other. FIG. 4B is a cross-section view that shows courses of the light in that instance.

Figure 4C:
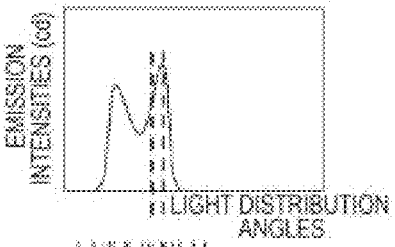
FIG. 4C is a diagram that shows a light quantity distribution when the lens central axes 35 are displaced to the right sides of the LED light source central axes 36 in the illumination device of the second embodiment.
Figure 4D:
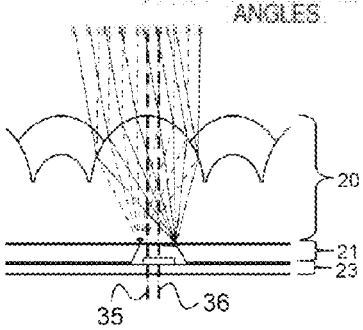
FIG. 4D is a cross-section view that illustrates a traveling state of the light in the instance of FIG. 4C.
Figure 4E:
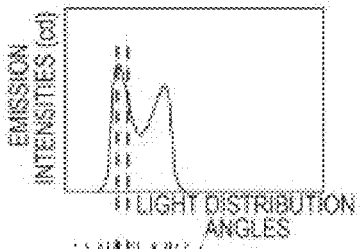
FIG. 4E is a diagram that shows a light quantity distribution when the lens central axes 35 are displaced to the left sides of the LED light source central axes 36 in the illumination device of the second embodiment.
Figure 4F:
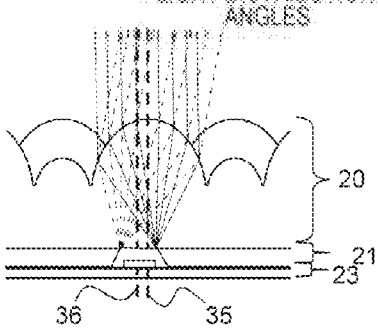
FIG. 4F is a cross-section view that illustrates a traveling state of the light in the instance of FIG. 4E.

FIG. 4E shows a light quantity distribution when lens central axes 35 are displaced to the left side of LED light source central axes 36. FIG. 4F is a cross-section view that show courses of the light in that instance.

FIG. 4C shows a light quantity distribution when the lens central axes 35 are displaced to the right side of the LED light source central axes 36. FIG. 4D is a cross-section view that shows courses of the light in that instance.

In FIGS. 4A, 4C and 4E, the light from both edges of the opening 25 is intense, and is divided into two peaks.

Figure 4G:
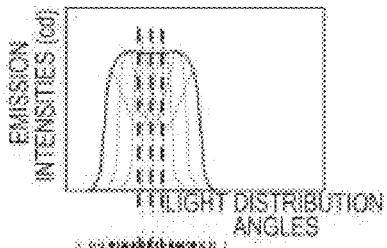
FIG. 4G is a diagram that shows a light quantity distribution in one illumination device 200 having respective LED light sources 22 with conditions of FIGS. 4A, 4C and 4E.
Figure 4H:
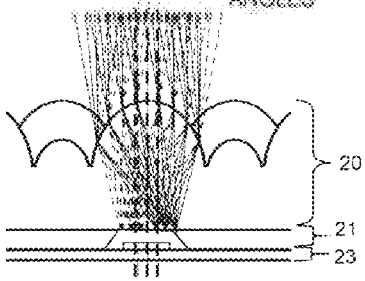
FIG. 4H is a cross-section view that illustrates a traveling state of the light in the instance of FIG. 4G.

FIG. 4G shows a light quantity distribution in one illumination device 200 having each of LED light sources 22 with conditions of FIG. 4A, FIG. 4C, and FIG. 4E. FIG. 4H is a cross-section view that shows courses of the light in that instance. The illumination devices 200 include those in which displacement of the positions does not occur, and those in which displacement of the positions occur. Since the light is combined, uniform light will be produced at the top portion, as seen in FIG. 4G. The case of the second embodiment is more preferable than the case of the first embodiment.

Figure 5:
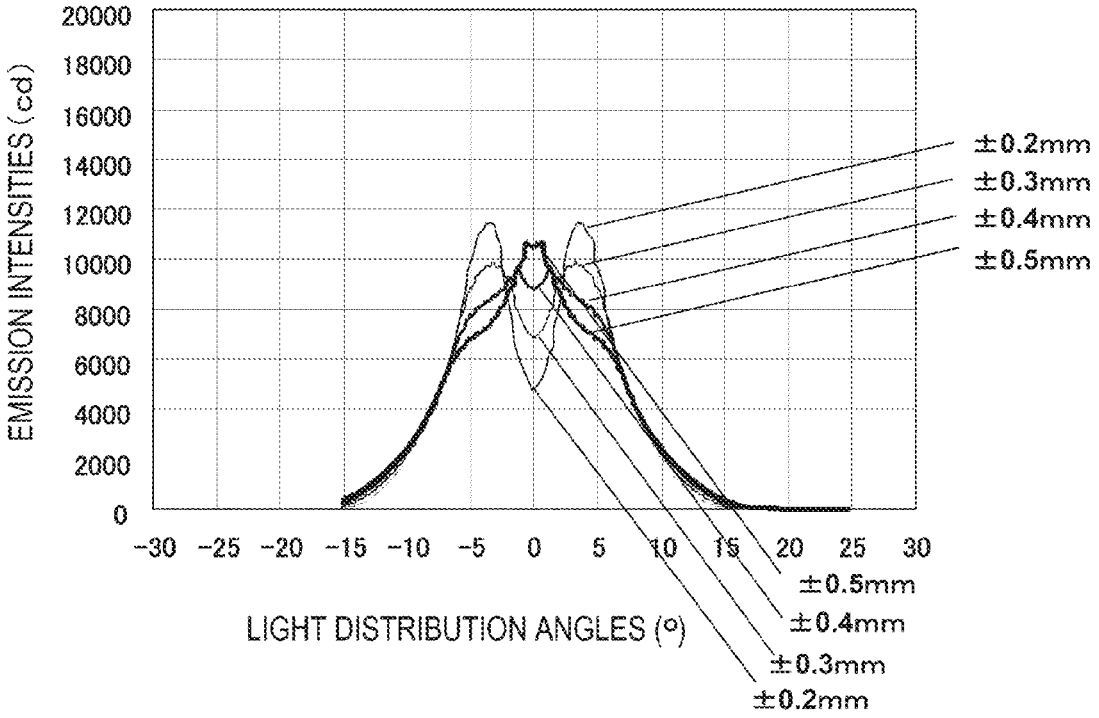
FIG. 5 is a diagram that shows a light quantity distribution in the illumination device according to the second embodiment.

FIG. 5 shows a light quantity distribution for each of cases where positions of the LED light sources 22 and the lenses 201 are displaced to the right or left by ±0.2 mm, ±0.3 mm, ±0.4 mm, and ±0.5 mm in the illumination device. The horizontal width of the opening upper part 251 is 2 mm.

In order to suppress a difference in the intensity at the peak of the emission intensity by 30%, i.e., to a range of about 3000 cd, ±0.3 mm or more and ±0.5 mm or less are preferable.

In other words, a range of 0.6/2 (=0.3 (30%)) of the opening width to ½ (=0.5 (50%)) of the opening width in the position-displacing direction is preferable. This is a condition for one direction. However, the same applies even to another direction.

In addition, to produce the above effects, it is required that the light overlaps. Therefore, in an illumination device in which LED light sources 22 are arrayed in one direction, it is required that three or more of the LED light sources 22 are arrayed in the one direction. In an illumination device 200 in which LED light sources 22 are planarly arrayed in two direction, it is required that 9 (3×3) or more of the LED light sources 22 are arrayed therein. Naturally, a lens unit 20 and a reflector unit 21 that suit them are also required.

Third Embodiment

The third embodiment will be described by use of FIGS. 6A and 6B. The matters not mentioned herein are the same as those in the first embodiment.

Figure 6A:
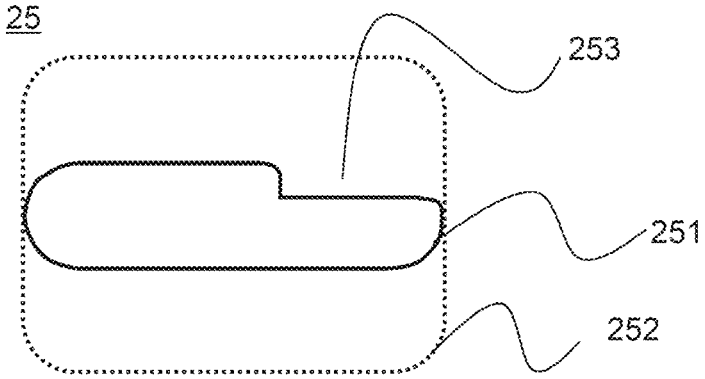
FIG. 6A is an enlarged plan view of an opening in a reflector unit in a third embodiment.

FIG. 6A is a diagram that shows an opening 25 of a reflector unit 21. The diagram is a plan view of the opening 25 viewed from a lens unit 20. FIG. 6A is a diagram that corresponds to FIG. 2B.

Figure 6B:
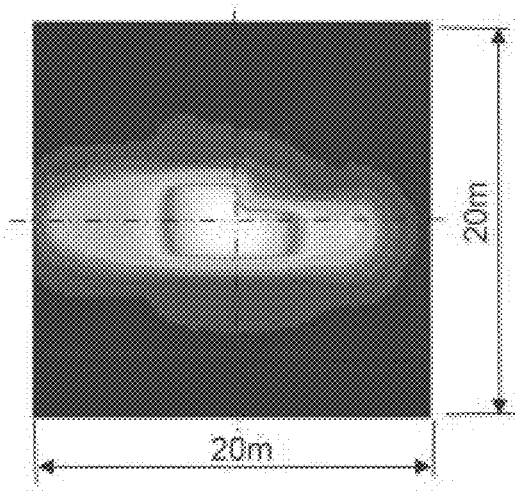
FIG. 6B is a diagram that shows a light quantity distribution at a point 25 m ahead in the instance of FIG. 6A.

FIG. 6B is a diagram that shows a light quantity distribution at a point 25 m ahead when the illumination device 200 is turned on with the reflector unit 21.

There is a cut part 253 in the opening 25. Because motorcycles and automobiles run on one side (on the right side or on the left side) of the road, the cut part 253 is provided to prevent irradiation with the light to oncoming vehicles. In cases of right-hand traffic, the cut part 253 is located at the bottom right of the opening 25 as viewed from the side of the lens unit 20.

As seen from FIG. 6B, the light is emitted according to the shape of the opening upper part 251. In FIG. 6B, the range of the light is restricted.

Even in an illumination device 200 for those other than motorcycles and automobiles, the shape of the opening upper part 251 can be changed, as needed, to restrict the range of the light.

In one illumination device 200, it is not required that shapes of openings are made identical, and areas or shapes of openings can be changed depending on their positions, thereby forming a light distribution into a desired shape.

The shapes of the opening parts may be a shape of a rectangle or ellipse, or semicircle or semi-ellipse having different horizontal or vertical sizes. The shapes of the opening parts may be an L-shape. One part of each of the figures may be blocked so as to cut the light.

Fourth Embodiment

Figure 7:
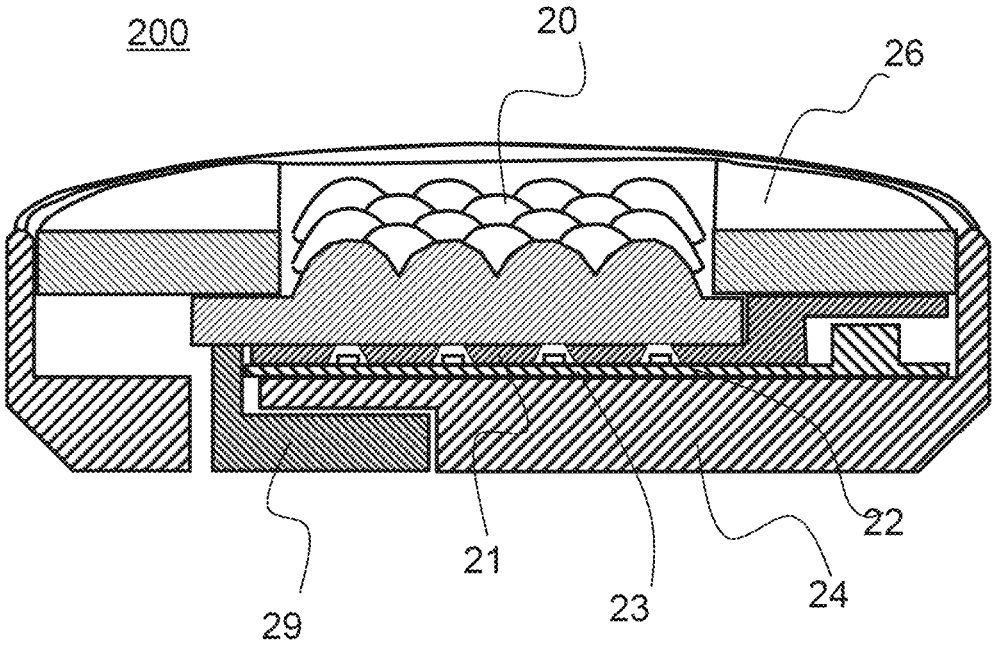
FIG. 7 is a perspective view of a cross-section of an illumination device according to a fourth embodiment.
Figure 8:
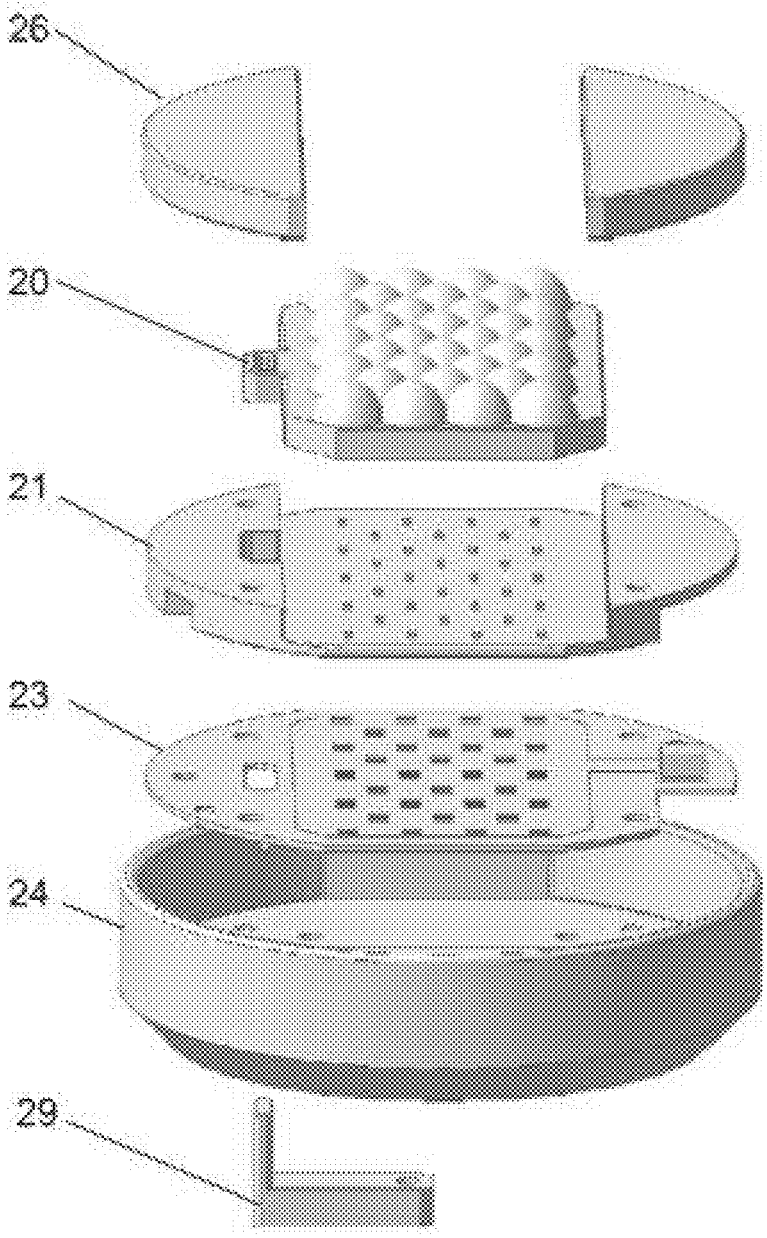
FIG. 8 is an exploded perspective view of the illumination device according to the fourth embodiment.

By using FIGS. 7 and 8, the fourth embodiment will be described. Matters not mentioned herein are the same as those in the first embodiment. FIG. 7 is a perspective view of a cross-section of an illumination device 200 according to the fourth embodiment. FIG. 8 is a perspective view of respective members where the respective members are resolved.

The illumination device 200 includes a lens presser 26, a lens unit 20, a reflector unit 21, a substrate 23, a frame 24, and a drive link 29. They are layered in this order in the illumination device 200.

The lens presser 26 presses the lens unit 20 onto the frame 24. In the lens unit 20, plural lenses are integrated. The reflector unit 21 is present above the LED light sources 22, and converges light from LED light sources 22.

The substrate 23 is a substrate in which LED light sources 22 are mounted. The substrate 23 has wirings and the like that supply power to the LED light sources 22 and that control the same. The frame 24 is a frame body that holds the above-mentioned members. The drive link 29 is a unit that is combined with the lens unit 20 and that moves the lens unit 20. The drive link 29 is connected to a drive member such as a motor, although such a drive member is not shown in the figure.

Other members other than the lens unit 20 have an opening and a projection for positioning, and thus, their positions are fixed. Although the lens unit 20 is combined with a projection of the drive link 29, the lens unit 20 is provided with play parts for other members, and can move around by about 2 mm.

<Movement>

For the movement, the lens unit 20 is relatively moved with respect to the substrate 23 and the reflector unit 21. By moving the drive link 29, the lens unit 20 is allowed to move. The same structure can be adopted for moving not only the lens unit 20 but also the reflector unit 21.

<Spectrum>

Figure 9:
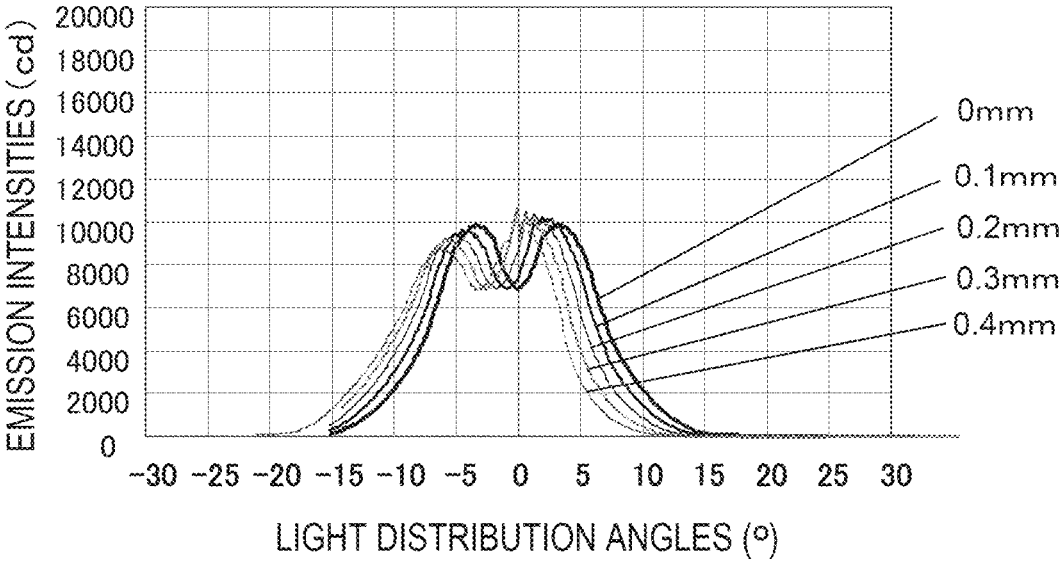
FIG. 9 is a diagram that shows a light distribution when a lens unit is moved in the illumination device according to the fourth embodiment.

FIG. 9 shows a spectrum of the light when the lens unit 20 is moved. The vertical axis indicates emission intensities, and the horizontal axis indicates light distribution angles. It shows light distribution angles and emission intensities when the lens unit 20 is moved by 0 mm, 0.1 mm, 0.2 mm, 0.3 mm and 0.4 mm. The light distribution is shifted by about 0.7° at the movement of 0.1 mm.

FIGS. 10A to 12D refer to light distributions and light distribution properties at a point 25 m ahead of the illumination devices 200. The light distribution properties refer to property diagrams in which distributions of illumination intensities are shown on circular coordinates where the light distribution angles are shown in the circumferential direction and the illumination intensities are shown in the radial direction, in a case where the illumination device 200 is placed in the center, and a target surface, which is present at a point 25 m ahead of the illumination device 200, is irradiated by turning on the illumination device 200 where the direction of 0° is adopted as a main emission direction.

Figure 10A:
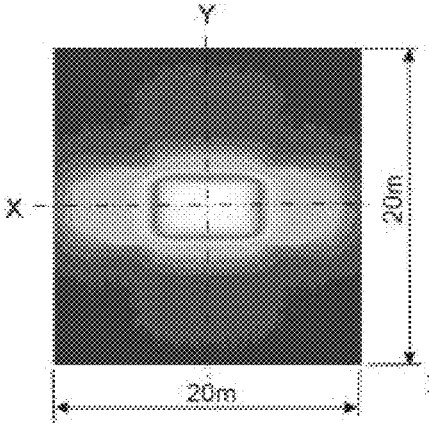
FIG. 10A is a diagram that shows alight distribution at a point 25 m ahead of the illumination device according to the fourth embodiment in a state where positions of the lenses and the LED light sources agree with each other in the illumination device.
Figure 10B:
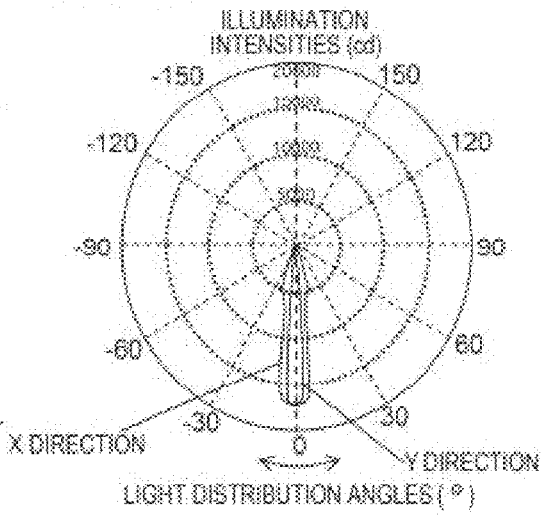
FIG. 10B is a diagram that shows a light distribution in the instance of FIG. 10A.

FIG. 10A is a diagram that shows light distributions at a position 25 m ahead of the illumination device 200 in a state where the lens 201 and the LED light source 22 agree with each other. FIG. 10B is a diagram that shows light distributions in that instance.

Figure 10C:
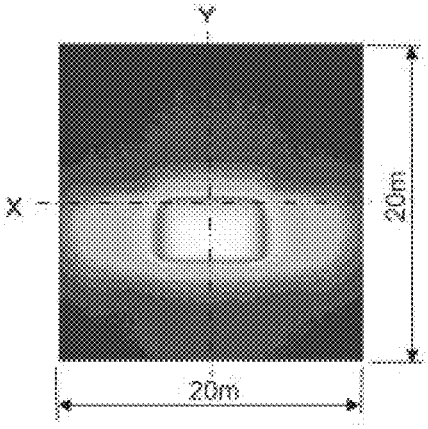
FIG. 10C is a diagram that shows alight distribution at a point 25 m ahead of the illumination device according to the fourth embodiment in a state where the lenses are shifted downward by 0.5 mm from the LED light sources in the illumination device.
Figure 10D:
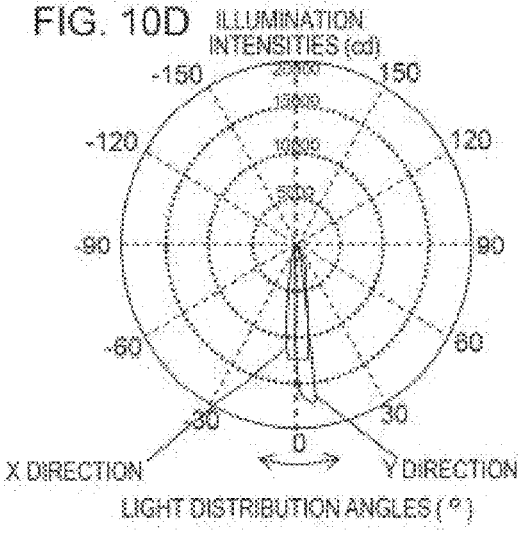
FIG. 10D is a diagram that shows a light distribution in the instance of FIG. 10C.

FIG. 10C is a diagram that shows light distributions at a position 25 m ahead of the illumination device 200 in a state where the lens 201 is shifted downward by 0.5 mm from the LED light source 22. FIG. 10D is a diagram that shows light distributions in that instance.

Figure 11A:
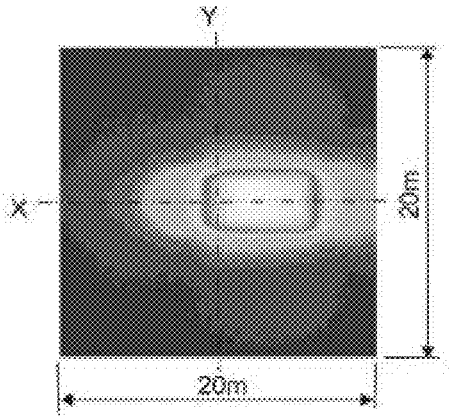
FIG. 11A is a diagram that shows alight distribution at a point 25 m ahead of the illumination device 200 according to the fourth embodiment in a state where the lenses are shifted to the right by 1.0 mm from the LED light sources in the illumination device.
Figure 11B:
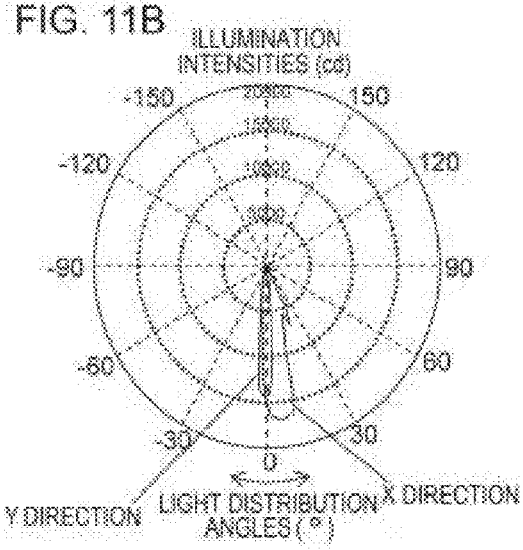
FIG. 11B is a diagram that shows a light distribution in the instance of FIG. 11A.

FIG. 11A is a diagram that shows illumination intensity distributions at a position 25 m ahead of the illumination device 200 in a state where the lens 201 is shifted to the right by 1.0 mm from the LED light source 22. FIG. 11B is a diagram that shows light distributions in that instance.

Figure 11C:
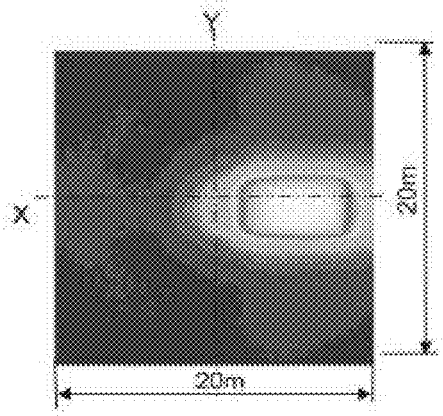
FIG. 11C is a diagram that shows alight distribution at a point 25 m ahead of the illumination device 200 according to the fourth embodiment in a state where the lenses are shifted to the right by 2.0 mm from the LED light sources in the illumination device.
Figure 11D:
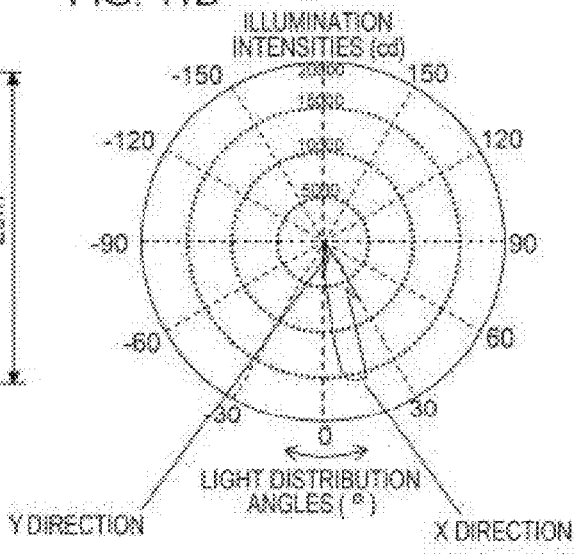
FIG. 11D is a diagram that shows a light distribution in the instance of FIG. 11C.

FIG. 11C is a diagram that shows illumination intensity distributions at a position 25 m ahead of the illumination device 200 in a state where the lens 201 is shifted to the right by 2.0 mm from the LED light source 22. FIG. 11D is a diagram that shows light distributions in that instance.

Figure 12A:
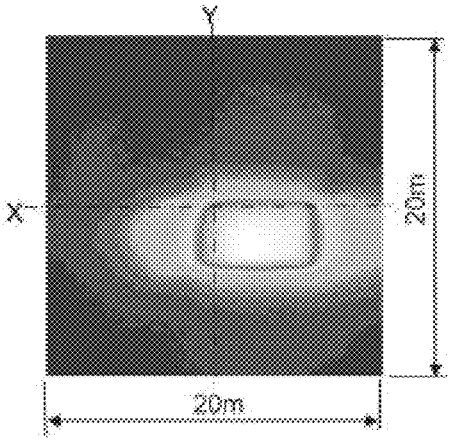
FIG. 12A is a diagram that shows alight distribution at a point 25 m ahead of the illumination device according to the fourth embodiment in a state where the lenses are shifted to the right by 2.0 mm and downward by 0.5 mm from the LED light sources in the illumination device.
Figure 12B:
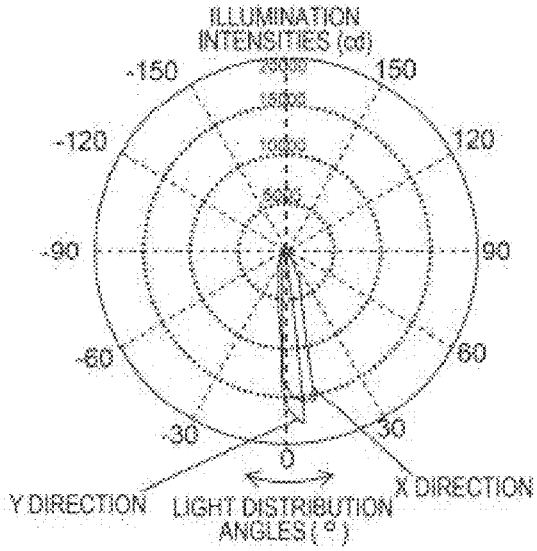
FIG. 12B is a diagram that shows a light distribution in the instance of FIG. 12A.

FIG. 12A is a diagram that shows illumination intensity distributions at a position 25 m ahead of the illumination device 200 in a state where the lens 201 is shifted to the right by 1.0 mm and downward by 0.5 mm from the LED light source 22. FIG. 12B is a diagram that shows light distributions in that instance.

Figure 12C:
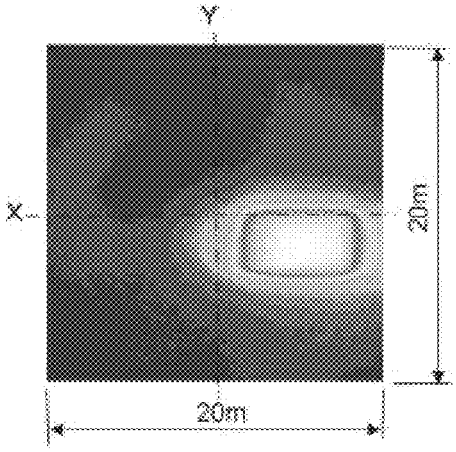
FIG. 12C is a diagram that shows alight distribution at a point 25 m ahead of the illumination device according to the fourth embodiment in a state where the lenses are shifted to the right by 2.0 mm and downward by 0.5 mm from the LED light sources in the illumination device.
Figure 12D:
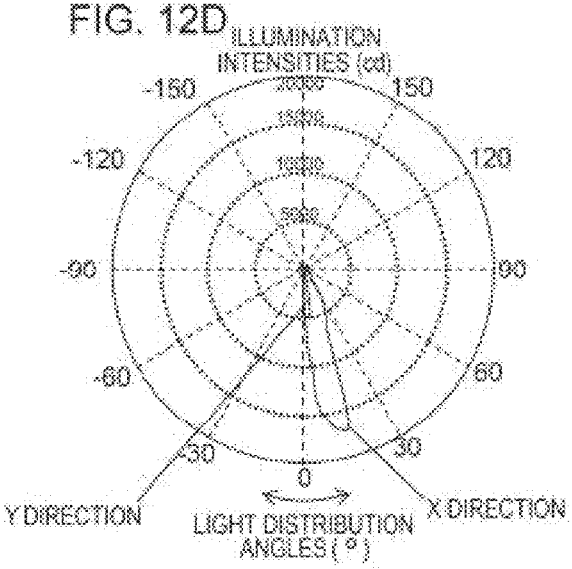
FIG. 12D is a diagram that shows a light distribution in the instance of FIG. 12C.

FIG. 12C is a diagram that shows illumination intensity distributions at a position 25 m ahead of the illumination device 200 in a state where the lens 201 is shifted to the right by 2.0 mm and downward by 0.5 mm from the LED light source 22. FIG. 12D is a diagram that shows light distributions in that instance.

Depending on displacement of the position of the lens unit 20, light distributions also vary in each of the cases. It is understood that the light distribution can arbitrarily be controlled.

When positions of the lens unit 20 and the reflector unit 21 are displaced, the light distribution shifts by about 0.7°/0.1 mm. Based on movement of the lens unit 20, the light distribution can be allowed to change.

From this, when an illumination device 200 is installed in an automobile, the light distribution direction can be changed depending on a turning angle of a steering wheel during cornering. By moving the lens unit 20, the light distribution can be changed. By the movement thereof by 2 mm, the light distribution direction can be changed by about 15°.

It is also possible to switch between a high beam and a low beam. By a movement of 0.6 mm, the light distribution can be changed by about 5°. The light distribution can be changed in the same manner, also as a house illumination device, outdoor illumination device, or commercially used illumination device.

<Movement of Reflector>

FIGS. 13A to 13D show a case where not a lens unit 20 but a reflector unit 21 is moved. The reflector unit 21 is moved with respect to the lens unit 20 and the substrate 23.

Figure 13A:
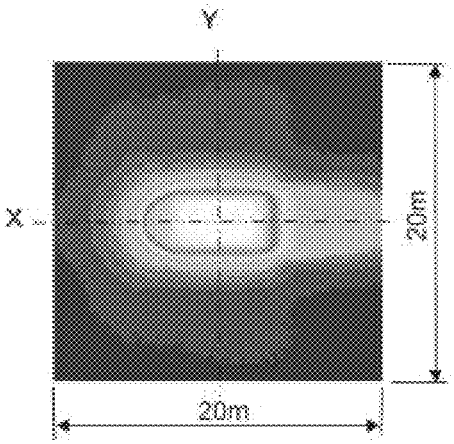
FIG. 13A is a diagram that shows a light quantity distribution at a point 25 m ahead of the illumination device according to the fourth embodiment when the reflector unit is shifted to the left by 1 mm in the illumination device.
Figure 13B:
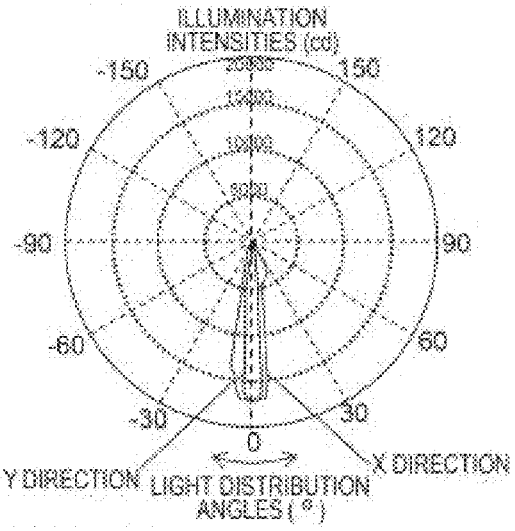
FIG. 13B is a diagram that shows a light distribution state in the instance of FIG. 13A.

FIG. 13A shows illumination intensity distributions at a position 25 m ahead of the illumination device 200 when the reflector unit 21 is shifted to the left by 1 mm. FIG. 13B shows a light distribution state in that instance.

Figure 13C:
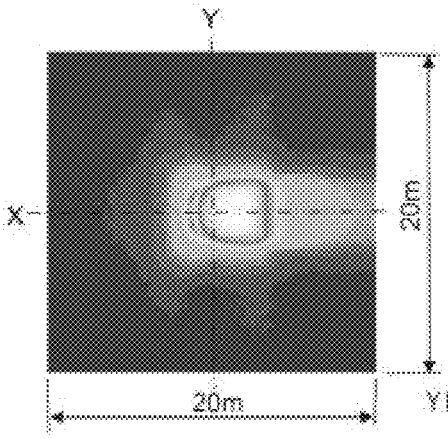
FIG. 13C is a diagram that shows a light quantity distribution at a point 25 m ahead of the illumination device according to the fourth embodiment when the reflector unit is shifted to the left by 2 mm in the illumination device.
Figure 13D:
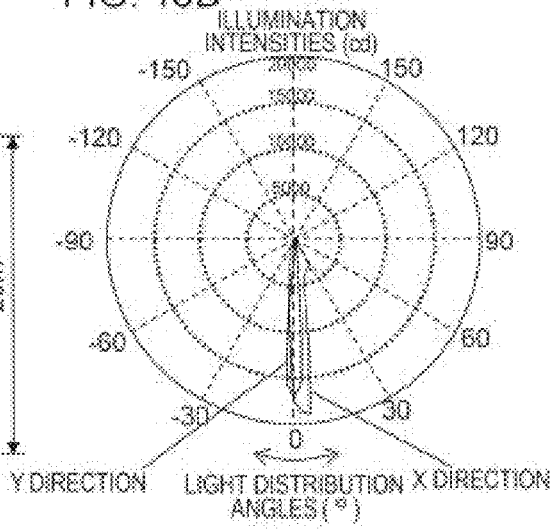
FIG. 13D is a diagram that shows a light distribution state in the instance of FIG. 13C.

FIG. 13C shows illumination intensity distributions at a position 25 m ahead of the illumination device 200 when the reflector unit 21 is shifted to the left by 2 mm. FIG. 13D shows a light distribution state in that instance.

When the reflection plate is moved, the light distribution angle varies.

When FIGS. 13C and 13D are compared with FIGS. 11C and 11D, respectively, degrees of changes in illumination intensity distributions in FIGS. 13C and 13D are obviously larger.

When, in a case where the reflector unit 21 is moved, the movement distance thereof is small, the light from LED light sources 22 is distributed depending on the lens unit 20. However, when the movement distance becomes large, the portions that are cut in the opening upper parts 251 of the reflector unit 21 become large, and distributions of the light deform.

This is because an optical system is established between the LED light source 22 and the lens 201, the light cannot be collected due to large movement of the opening 25 of the reflector unit 21 therebetween, and the light is cut. There will be no problem when the movement distance is within a half of the size of the opening upper part 251.

Therefore, it is more preferable that, while the LED light source 22 and the reflector unit 21 are fixed, the lens unit 20 is moved. However, the same effects can be exerted even when the reflector unit 21 is moved, as long as the movement is within a certain range.

In addition, it is more preferable that position displacement of the lens unit 20 and LED light sources 22 in the second embodiment are further combined.

Fifth Embodiment

The fifth embodiment will be described by using FIGS. 14 and 15. Matters not described herein are the same as those in the first embodiment.

Figure 14:
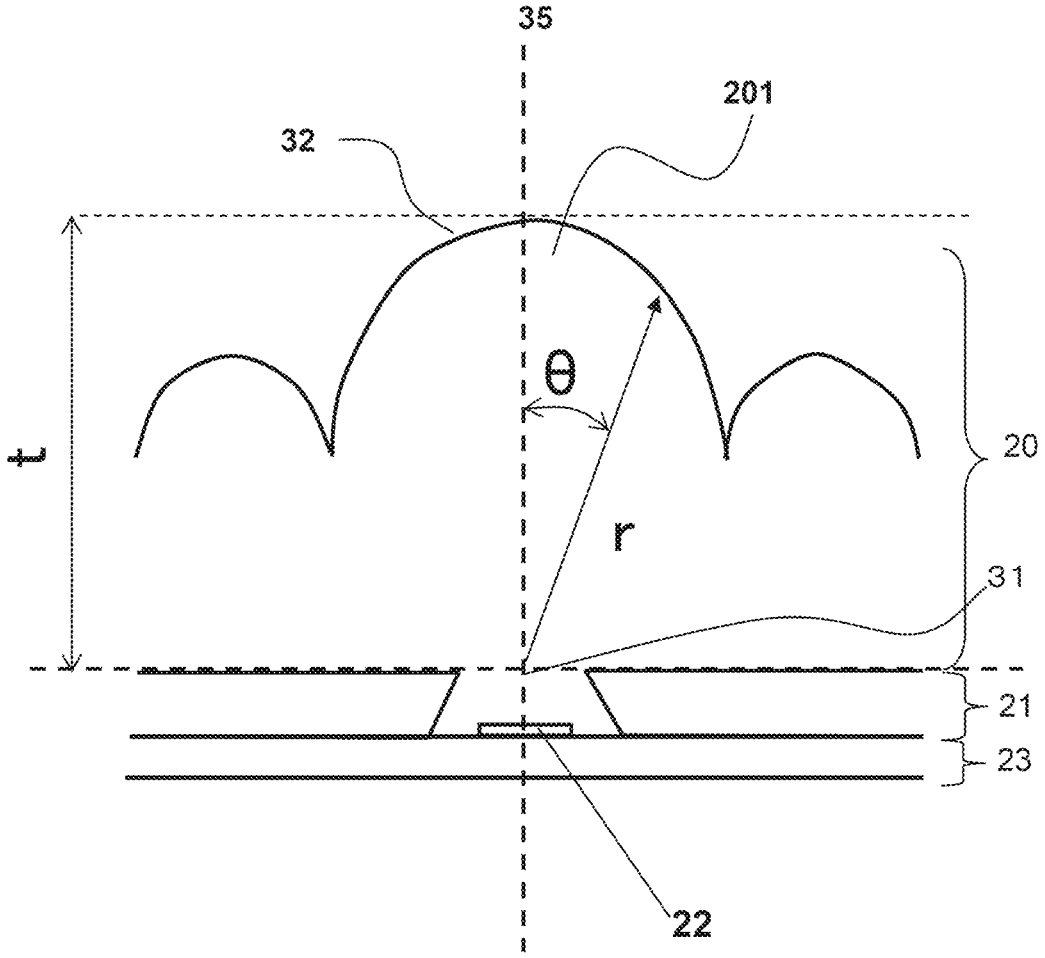
FIG. 14 is a cross-section view of an illumination device according to a fifth embodiment.

FIG. 14 shows a cross-section view of an illumination device 200. A lens light-emitting surface 32 that is an outermost surface of a lens 201 is formed of a spherical surface with one radius. A relation of a radius r, which is a distance between a focal point of the lens 201 and the lens light-emitting surface 32; an angle θ, which is formed by a lens central axis 35 and the radius r; a refractive index n of the lens; and a lens thickness t is expressed as the following formula 1.

$$r=(n-1)\times t/(n-\cos\theta) \quad \text{(Formula 1)}$$

Based on this shape, the light from LED light source 22 is emitted upward.

Figure 15:
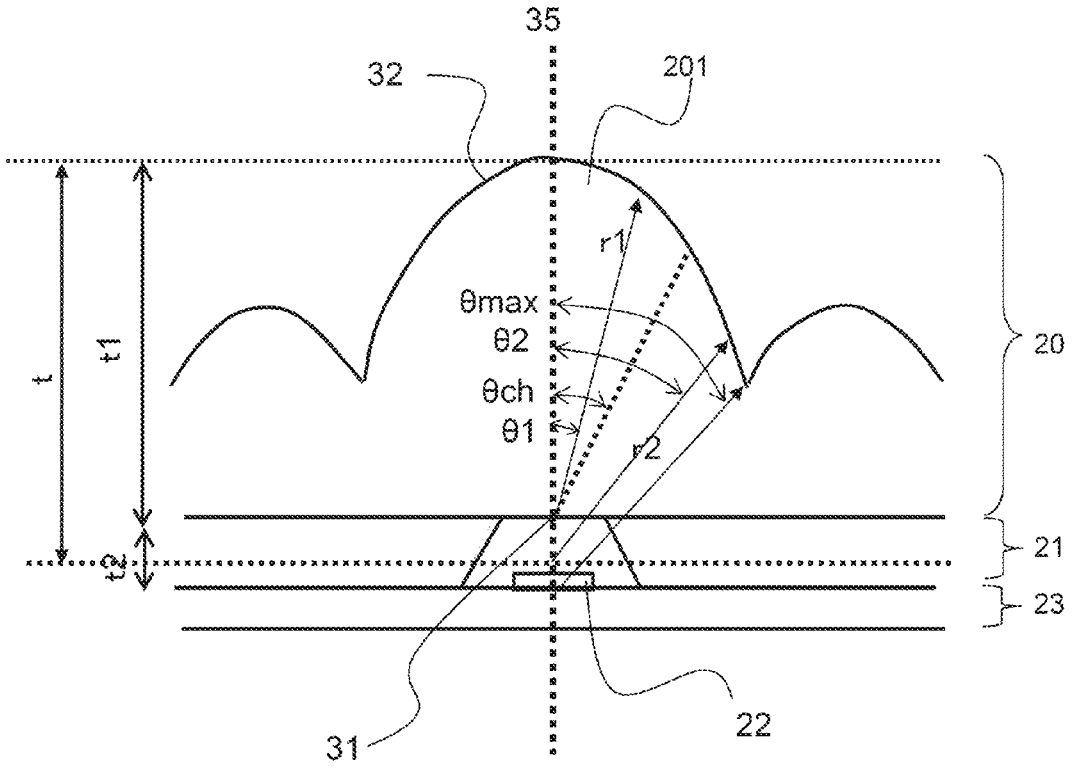
FIG. 15 is a cross-section view of the illumination device according to the fifth embodiment.

Furthermore, it is more preferable that the lens is formed as shown in FIG. 15. FIG. 15 shows a cross-section view of an illumination device 200. The lens shape is formed by two types of radii r1 and r2.

The radius r1 satisfies the following formula 2.

$$r1=(n-1)\times t1/(n-\cos\theta 1) \quad \text{(Formula 2)}$$

The radius r2 satisfies the following formula 3.

$$r2=(n-1)\times t2/(n-\cos\theta 2) \quad \text{(Formula 3)}$$

t1 and t2 in the above formulas satisfy the following formula.

$$t=t1+t2(\theta 2-\theta ch)/(\cos-1(1/n)-\theta ch) \quad \text{(Formula 4)}$$

In the above formulas, the radius r1 is a radius where the angle θ1 is 0° to an angle θch. This radius r1 is a distance from the lens focal point 31 to the lens light-emitting surface 32.

The radius r2 is a radius where the angle θ2 is from an angle θch to a maximum angle θmax. This radius r2 is a distance from a position, which is present on the lens central axis 35 and that is distant from the top of the lens 201 by a thickness t therefrom, to the lens light-emitting surface 32. A refractive index n is a refractive index of the lens.

The angle θ1 and the angle θ2 are angles from the lens central axis 35. The maximum angle θmax is an angle in a border with an adjacent lens. The angle θch is an angle in a boundary between the radius r1 and the radius r2.

When the angle θ2=cos−1 (1/n), t=t1+t2. The thickness t1 is a maximum thickness of the lens unit 20. The thickness t2 can be any given value, and is desirably larger than a distance between a point, where a line passing through the edge of the opening upper part 251 intersects with a light axis, and the bottom surface of the lens, when the angle θ2=cos−1 (1/n).

In the lens of FIG. 15, the light can more efficiently be guided upward, compared with the lens of FIG. 14. Descriptions thereon will be made by FIGS. 16A and 16B.

Figure 16A:
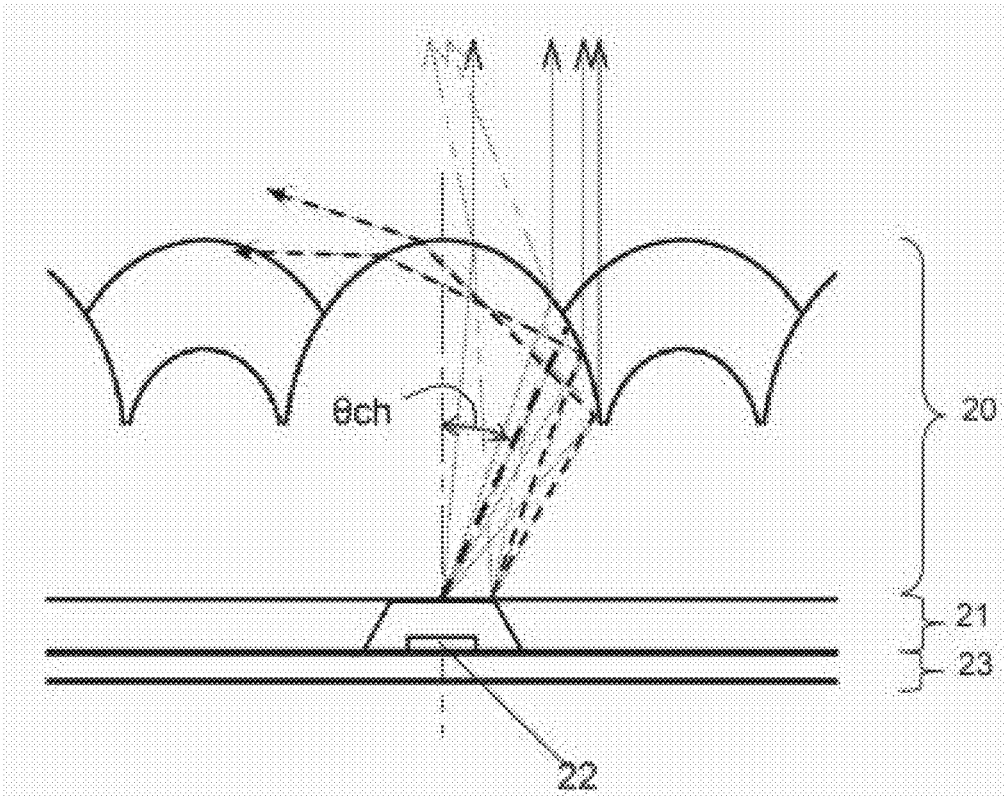
FIG. 16A is a diagram that illustrates travel of the light in the lens of FIG. 14 according to the fifth embodiment.

FIG. 16A is a cross-section view of the illumination device 200 in the case of FIG. 14. Courses of the light are indicated by dotted lines and solid lines. A part of the light at an angle of θch or higher is totally reflected, and significantly changes its direction, and travels to the side direction.

Figure 16B:
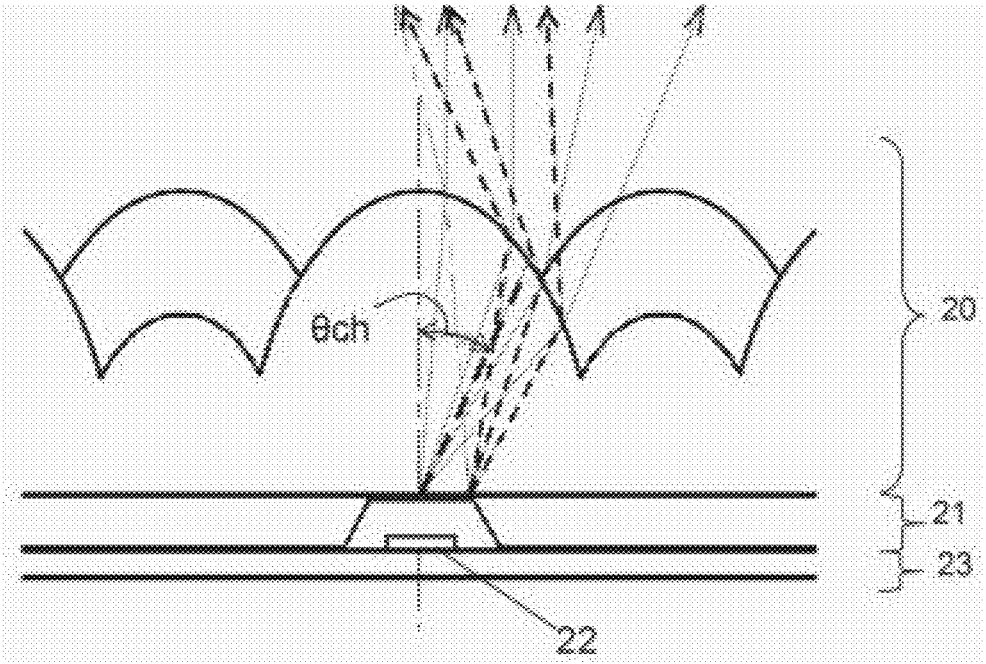
FIG. 16B is a diagram that illustrates travel of the light in the lens of FIG. 14 according to the fifth embodiment.

FIG. 16B is a cross-section view of the illumination device 200 in the case of FIG. 15. Courses of the light are indicated by dotted lines and solid lines. The light at an angle of θch or higher is not totally reflected, and does not significantly changes its direction, and travels upward.

In the structure of FIG. 15, the radius is changed around the angle θch, thereby suppressing the total reflection of the light. The centers of the two types of radii are displaced at in the central part and at the side surface, thereby emitting every light upward.

The above-described first to fourth embodiments can be combined to exert more effects.

Sixth Embodiment

The sixth embodiment will be described by use of FIGS. 17A to 20G. Matters not mentioned herein are the same as those in the first embodiment. The data described below are data that were obtained based on an optical simulation. Conditions not described herein are the same as those in the first embodiment.

Figure 17A:
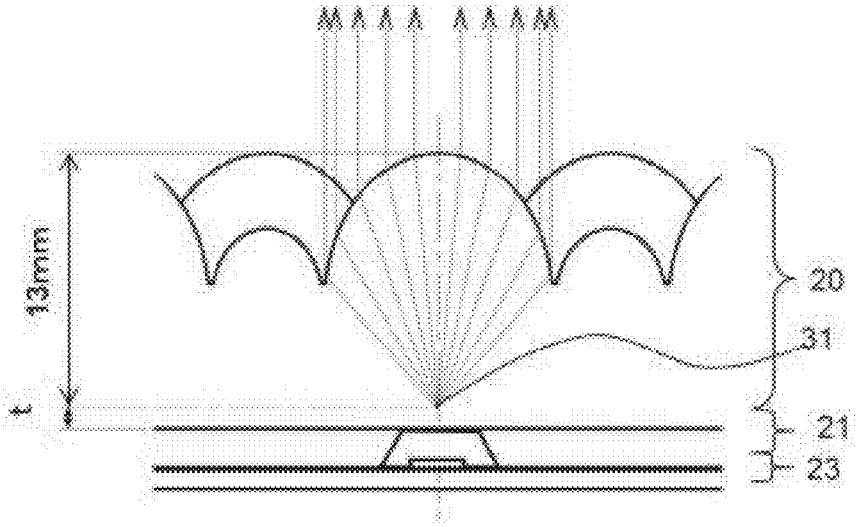
FIG. 17A is a cross-section view of an illumination device according to a sixth embodiment.
Figure 17B:
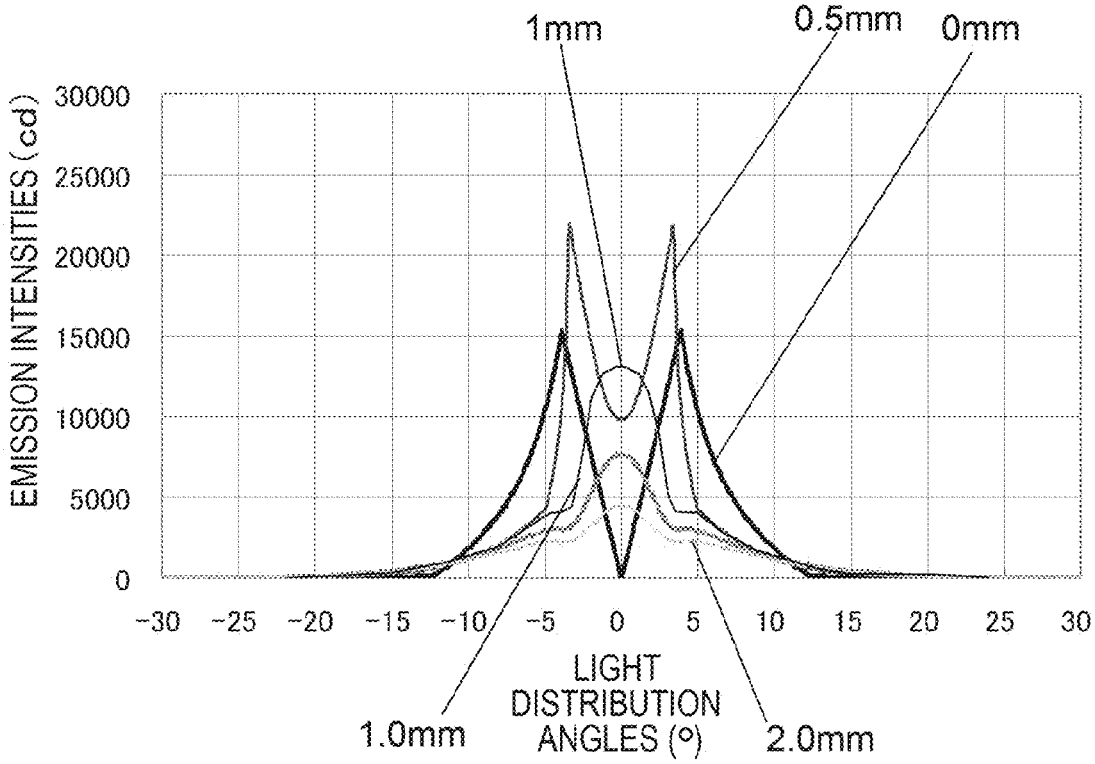
FIG. 17B is a diagram that shows a relation between light distribution angles and emission intensities when positions of the lens focal points are varied in the illumination device of the sixth embodiment.

FIGS. 17A and 17B refer to a case where the lens focal point 31 is located above the top surface of the reflector unit 21. FIG. 17A is a cross-section view. FIG. 17B shows a relation between light distribution angles and emission intensities when a distance t between the top surface of the reflector unit 21 and the lens focal point 31 is varied.

Figure 18A:
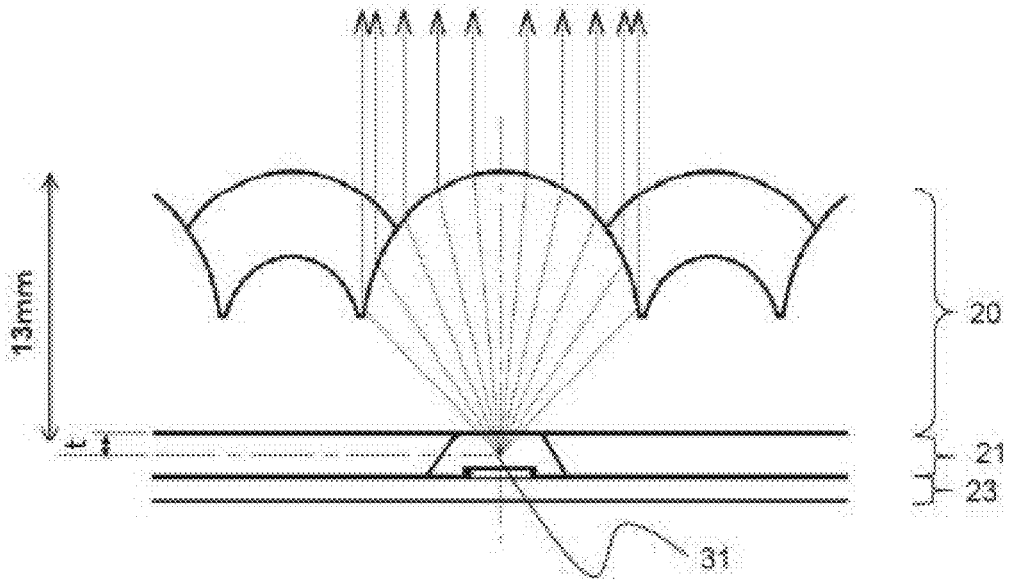
FIG. 18A is a cross-section view of the illumination device according to the sixth embodiment.
Figure 18B:
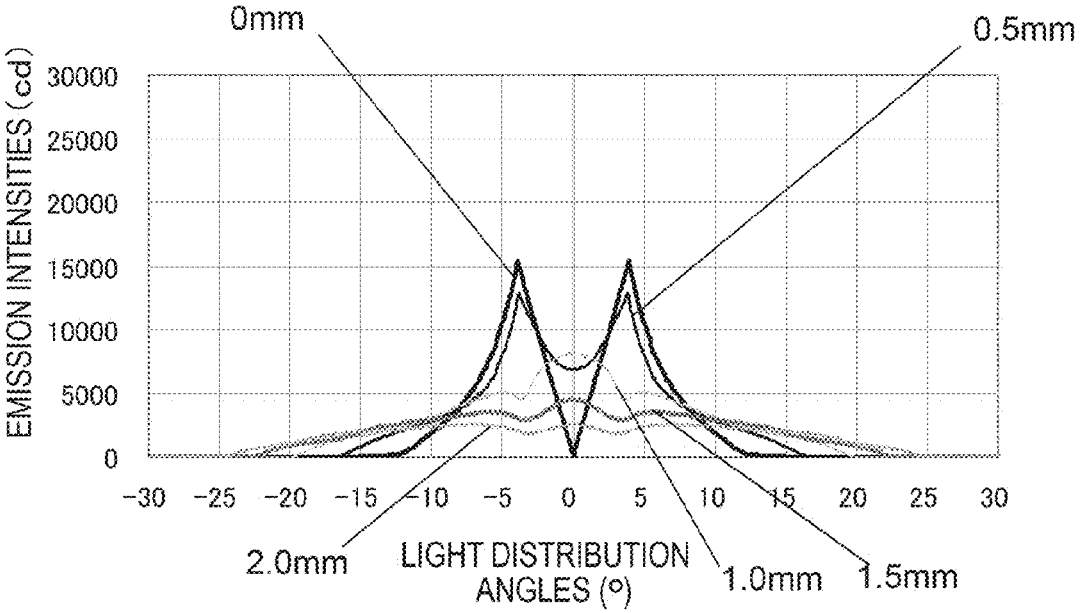
FIG. 18B is a diagram that shows a relation between light distribution angles and emission intensities when positions of the lens focal points are varied in the illumination device according to the sixth embodiment.

FIGS. 18A and 18B refer to a case where the lens focal point 31 is located below the top surface of the reflector unit 21. FIG. 18A is a cross-section view. FIG. 18B shows a relation between light distribution angles and emission intensities when a distance t between the top surface of the reflector unit 21 and the lens focal point 31 is varied.

When FIG. 17B and FIG. 18B are compared with each other, and emission intensities in FIG. 17B are generally higher. The light emitted from the lens focal point 31 is guided upward without any loss. As a result, it is preferred that the lens focal point 31 is present at a position higher than the top surface of the reflector unit 21 by 0.5 mm.

Next, position displacement (in the lateral direction and in the horizontal direction) will be studied for a case where the lens focal point 31 is located on the top surface of the reflector unit 21, and for a case where the reflector unit 21 is located above the top surface of the reflector unit 21.

Figure 19A:
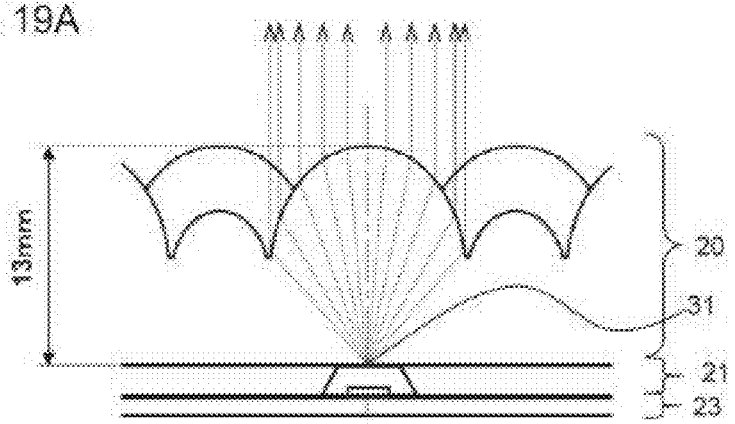
FIG. 19A is a cross-section view of the illumination device according to the sixth embodiment.

FIG. 19A shows a cross-section view of an illumination device 200. FIGS. 19B to 19G show position displacements (in the lateral direction and in the horizontal direction) of the lens central axis 35 and the LED light source central axis 36 in a case where the lens focal point 31 is located on the top surface of the reflector unit 21 (0 mm), as well as emission intensities in that instance.

FIG. 19B, FIG. 19C, FIG. 19D, FIG. 19E, FIG. 19F, and FIG. 19G refer to cases of position displacements of 0 mm, 0.1 mm, 0.2 mm, 0.3 mm, 0.4 mm and 0.5 mm, respectively.

Figure 20A:
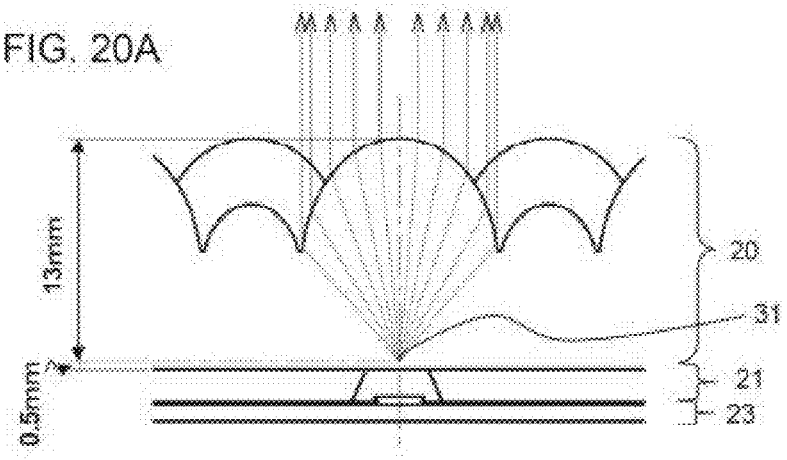
FIG. 20A is a cross-section view of the illumination device according to the sixth embodiment.

On the other hand, FIG. 20A shows a cross-section view of an illumination device 200. FIGS. 20B to 20G show position displacements (in the lateral direction and in the horizontal direction) of the lens central axis 35 and the LED light source central axis 36 in a case where the lens focal point 31 is located 0.5 mm above the reflector unit 21, as well as emission intensities in that instance.

FIG. 20B, FIG. 20C, FIG. 20D, FIG. 20E, FIG. 20F, and FIG. 20G refer to cases of position displacements of 0 mm, 0.1 mm, 0.2 mm, 0.3 mm, 0.4 mm and 0.5 mm, respectively.

Figure 19B:
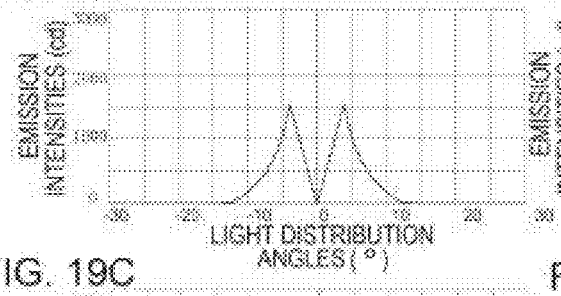
FIG. 19B is a diagram that shows a relation with emission intensities when position displacements between lens central axes and LED light source centers are 0.0 mm in the illumination device according to the sixth embodiment in a case where the lens focal points are present on the upper surface of the reflector unit.
Figure 19C:
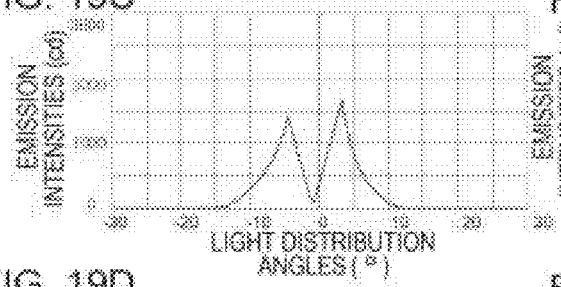
FIG. 19C is a diagram that shows a relation with emission intensities when position displacements between lens central axes and LED light source centers are 0.1 mm in the illumination device according to the sixth embodiment in a case where the lens focal points are present on the upper surface of the reflector unit.
Figure 19D:
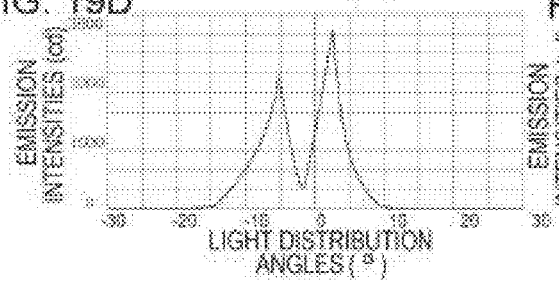
FIG. 19D is a diagram that shows a relation with emission intensities when position displacements between lens central axes and LED light source centers are 0.2 mm in the illumination device according to the sixth embodiment in a case where the lens focal points are present on the upper surface of the reflector unit.
Figure 19E:
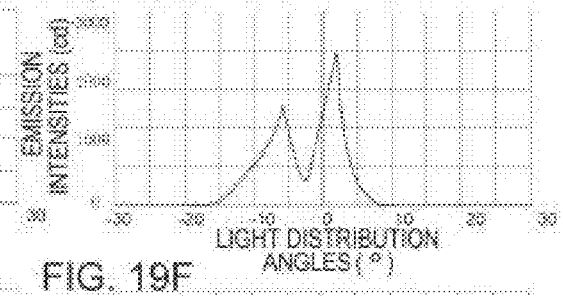
FIG. 19E is a diagram that shows a relation with emission intensities when position displacements between lens central axes and LED light source centers are 0.3 mm in the illumination device according to the sixth embodiment in a case where the lens focal points are present on the upper surface of the reflector unit.
Figure 19F:
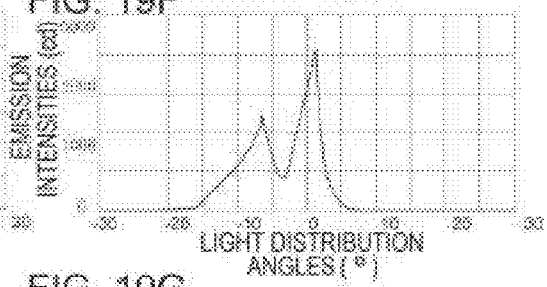
FIG. 19F is a diagram that shows a relation with emission intensities when position displacements between lens central axes and LED light source centers are 0.4 mm in the illumination device according to the sixth embodiment in a case where the lens focal points are present on the upper surface of the reflector unit.
Figure 19G:
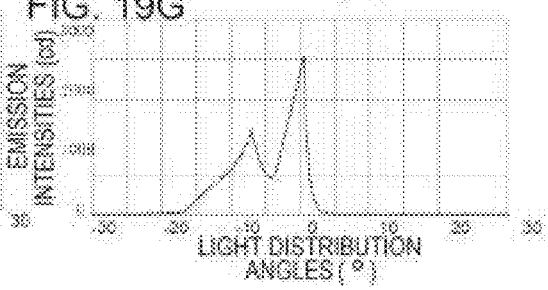
FIG. 19G is a diagram that shows a relation with emission intensities when position displacements between lens central axes and LED light source centers are 0.5 mm in the illumination device according to the sixth embodiment in a case where the lens focal points are present on the upper surface of the reflector unit.
Figure 20B:
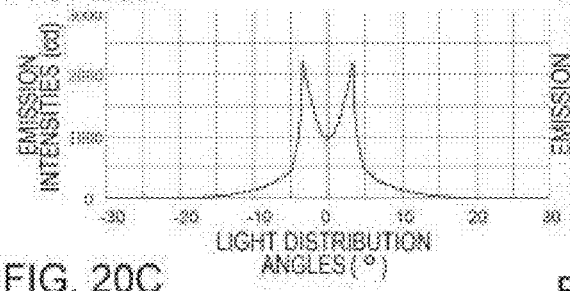
FIG. 20B is a diagram that shows a relation with emission intensities when position displacements between lens central axes and LED light source central axes are 0.0 mm in the illumination device according to the sixth embodiment in a case where the lens focal points are present 0.5 mm upward of the reflector unit.
Figure 20E:
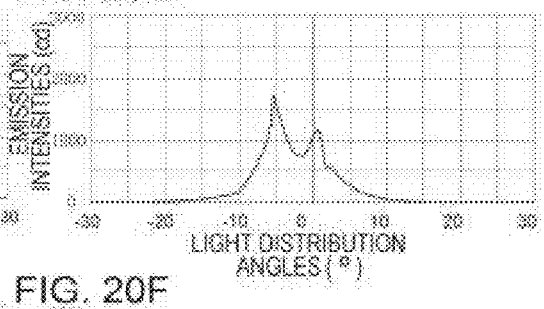
FIG. 20E is a diagram that shows a relation with emission intensities when position displacements between lens central axes and LED light source central axes are 0.3 mm in the illumination device according to the sixth embodiment in a case where the lens focal points are present 0.5 mm upward of the reflector unit.
Figure 20C:
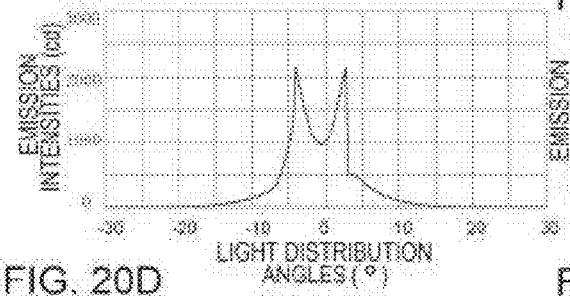
FIG. 20C is a diagram that shows a relation with emission intensities when position displacements between lens central axes and LED light source central axes are 0.1 mm in the illumination device according to the sixth embodiment in a case where the lens focal points are present 0.5 mm upward of the reflector unit.
Figure 20F:
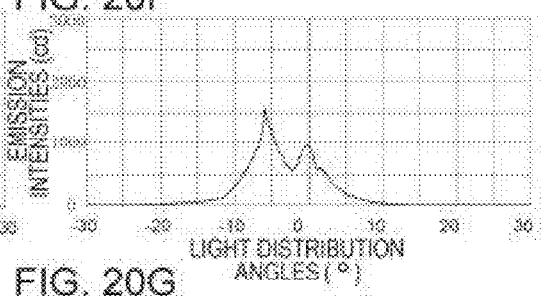
FIG. 20F is a diagram that shows a relation with emission intensities when position displacements between lens central axes and LED light source central axes are 0.4 mm in the illumination device according to the sixth embodiment in a case where the lens focal points are present 0.5 mm upward of the reflector unit.
Figure 20D:
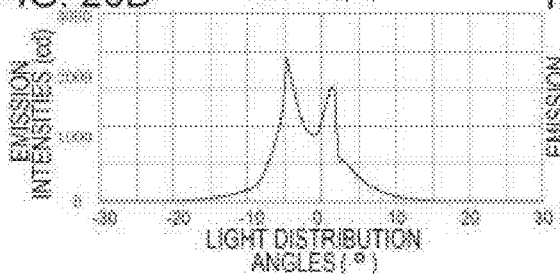
FIG. 20D is a diagram that shows a relation with emission intensities when position displacements between lens central axes and LED light source central axes are 0.2 mm in the illumination device according to the sixth embodiment in a case where the lens focal points are present 0.5 mm upward of the reflector unit.
Figure 20G:
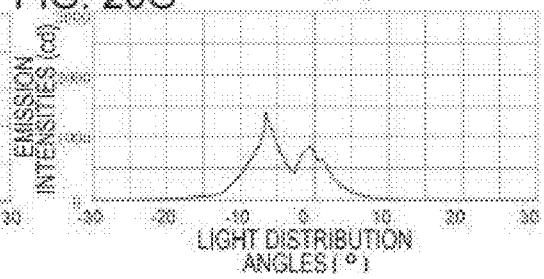
FIG. 20G is a diagram that shows a relation with emission intensities when position displacements between lens central axes and LED light source central axes are 0.5 mm in the illumination device according to the sixth embodiment in a case where the lens focal points are present 0.5 mm upward of the reflector unit.
Figure 21:
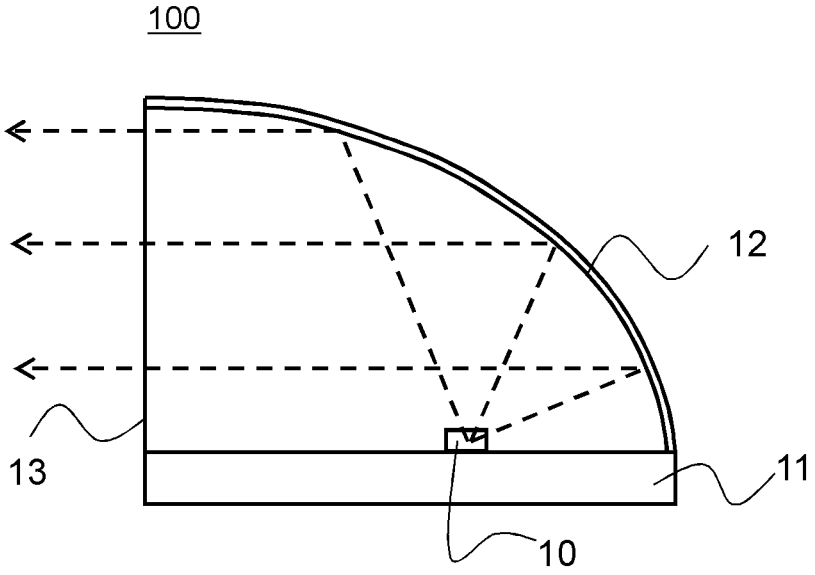
FIG. 21 PRIOR ART
FIG. 21 is a cross-section view of a conventional illumination device.

When FIG. 19B and FIG. 20B are compared with each other, the emission intensities in FIG. 20 are higher. The light emitted from the lens focal point 31 is guided upward without any loss. As a result, it is preferred that the lens focal point 31 is located at a position higher than the top surface of the reflector unit 21 by 0.5 mm. It is preferred that the lens focal point 31 is located at a position higher than the surface by about 0.2 to 0.8 mm.

In addition, the above-described embodiments can be combined.

INDUSTRIAL APPLICABILITY

The illumination device of the invention relates to a headlight for vehicles. However, the illumination device of the invention can also be used for other purposes such as an illumination device for buildings.

REFERENCE SIGNS LIST n refractive index
r radius
t distance
10 LED light source
11 substrate
12 reflection plate
13 opening
20 lens unit
21 reflector unit
22 LED light source
23 substrate
24 frame
25 opening
29 drive link
31 lens focal point
32 lens light-emitting surface
35 lens central axis
36 LED light source central axis
38 central axis
r1 radius
r2 radius
100, 200 illumination device
201 lens
251 opening upper part
252 opening lower part
253 cut part

The invention claimed is:

1. An illumination device, comprising:

plural light-emitting elements;

a reflection plate that has plural openings facing the plural light-emitting elements, respectively; and plural lenses that face the plural openings, respectively, each of the plural lenses guides light emitted from the respective opening in a direction vertical to the respective opening, wherein the reflection plate is placed between the plural light-emitting elements and the plural lenses, and converges the light emitted from the plural light-emitting elements, the plural light-emitting elements are located on a substrate, the plural lenses form a lens unit, and the substrate, the reflection plate and the lens unit are layered so as to be movable.

2. The illumination device according to claim 1, wherein the plural openings in the reflection plate have the same shape, and displacement amounts between center positions of the respective openings and central axes of the respective lenses facing to them differ from each other depending on positions.

3. The illumination device according to claim 1, wherein the plural openings in the reflection plate have different shapes.

4. The illumination device according to claim 1, wherein the plural openings in the reflection plate have a shape of one of a rectangle, an ellipse, a semicircle, and a semi-ellipse, the shape including a cut part.

5. The illumination device according to claim 1, wherein a shape of each of the plural openings in the reflection plate is a rectangle including a cut part on an edge of the rectangle.

6. The illumination device according to claim 2, wherein a maximum value for the displacement amounts between the center positions of the respective openings in the reflection plate and the central axes of the respective lenses facing to them is equal to or less than 50% of a width of the openings.

7. The illumination device according to claim 1, wherein displacement amounts between center positions of the respective openings in the reflection plate and central axes of the respective lenses facing to them become larger toward edges of the illumination device.

8. The illumination device according to claim 1, wherein outer shapes of the lenses are formed of a spherical outer peripheral surface having plural radii.

9. An illumination device, comprising:

plural light-emitting elements;

a reflection plate that has plural openings facing the plural light-emitting elements, respectively;

plural lenses that face the plural openings, respectively, each of the plural lenses guides light emitted from the respective opening in a direction vertical to the respective opening, and a driving device that drives a lens unit having the plural lenses in a direction horizontal to central axes of the lenses, wherein the reflection plate is placed between the plural light-emitting elements and the plural lenses, and converges the light emitted from the plural light-emitting elements.

10. The illumination device according to claim 1, wherein shapes on the lens side and shapes on the light-emitting-element side of the plural openings in the reflection plate are shapes of a rectangle, a length of the long side of the rectangle on the lens side is identical to that of the long side of the rectangle on the light-emitting-element side, a length of the short side of the rectangle on the lens side is smaller than that of the short side of the rectangle on the light-emitting-element side, and the lenses are hemispherical.

11. The illumination device according to claim 9, wherein the plural openings in the reflection plate have the same shape, and displacement amounts between center positions of the respective openings and central axes of the respective lenses facing to them differ from each other depending on positions.

12. The illumination device according to claim 9, wherein the plural openings in the reflection plate have different shapes.

13. The illumination device according to claim 9, wherein the plural openings in the reflection plate have a shape of one of a rectangle, an ellipse, a semicircle, and a semi-ellipse, the shape including a cut part.

14. The illumination device according to claim 9, wherein a shape of each of the plural openings in the reflection plate is a rectangle including a cut part on an edge of the rectangle.

15. The illumination device according to claim 9, wherein a maximum value for the displacement amounts between the center positions of the respective openings in the reflection plate and the central axes of the respective lenses facing to them is equal to or less than 50% of a width of the openings.

16. The illumination device according to claim 9, wherein displacement amounts between center positions of the respective openings in the reflection plate and central axes of the respective lenses facing to them become larger toward edges of the illumination device.

17. The illumination device according to claim 9, wherein outer shapes of the lenses are formed of a spherical outer peripheral surface having plural radii.

18. The illumination device according to claim 9, wherein shapes on the lens side and shapes on the light-emitting-element side of the plural openings in the reflection plate are shapes of a rectangle, a length of the long side of the rectangle on the lens side is identical to that of the long side of the rectangle on the light-emitting-element side, a length of the short side of the rectangle on the lens side is smaller than that of the short side of the rectangle on the light-emitting-element side, and the lenses are hemispherical.

* * * * *